United States Patent [19]

Zupanick

[11] 3,936,214

[45] Feb. 3, 1976

[54] PUMPING TWO-PHASE FLUIDS

[75] Inventor: Joseph E. Zupanick, Richardson, Tex.

[73] Assignee: Sun Oil Company, Dallas, Tex.

[22] Filed: Jan. 22, 1975

[21] Appl. No.: 542,996

[52] U.S. Cl. ..... 415/89; 415/88; 233/21; 233/27

[51] Int. Cl.[2] ..... F04D 29/08

[58] Field of Search ..... 415/88, 89; 233/21, 27

[56] References Cited

UNITED STATES PATENTS

| | | | |
|---|---|---|---|
| 2,376,071 | 5/1945 | Miess | 415/89 |
| 2,673,075 | 3/1954 | Borck | 415/89 |
| 2,680,007 | 6/1954 | Arbuckle | 415/89 |
| 3,093,080 | 6/1963 | Tarifa et al. | 415/89 |
| 3,374,747 | 3/1968 | King et al. | 415/89 |
| 3,384,023 | 5/1968 | King et al. | 415/89 |
| 3,838,939 | 10/1974 | Erickson | 415/89 |

FOREIGN PATENTS OR APPLICATIONS

| | | | |
|---|---|---|---|
| 128,170 | 5/1932 | Austria | 415/89 |
| 493,333 | 10/1938 | United Kingdom | 415/89 |
| 1,094,563 | 5/1955 | France | 415/89 |
| 1,176,486 | 8/1964 | Germany | 415/89 |

*Primary Examiner*—C. J. Husar

*Attorney, Agent, or Firm*—J. Edward Hess; Donald R. Johnson; William C. Roch

[57] ABSTRACT

A centrifugal pump of rotating case and fixed arm configuration having a plurality of orifices on the stationary arm to accomodate multi-phase flow whereby the mixed phase charge is separated and discharged at high pressure due to centrifugal force created by the case rotation.

3 Claims, 4 Drawing Figures

PUMPING TWO-PHASE FLUIDS

BACKGROUND OF THE INVENTION

1. Field of the Invention

The present invention relates to centrifugal pumps for fluids and more particularly of the type having a rotatable case which impels fluid to one collection point if liquid and another if gas whereby they are discharged separately via separate outlet ports within the pump housing.

2. Description of the Prior Art

The problem of two-phase fluid pumping has been and still is a serious one in the art, especially for long distance transmissions. Prior pumps, especially the rotating case-fixed arm centrifugal type as disclosed in U.S. Pat. No. 3,384,024 issued to W. L. King, can be adapted to solve this type of problem. This type of pump, for a single phase fluid, achieves high pressure liquid pumping in a small inexpensive single stage with relatively little maintenance such as mechanical seal problems which have long plagued the pumping art. Yet this group as it is presently known cannot achieve the two-phase or multi-phase operation which is the prime object of the present invention.

The invention described herein discloses in its preferred embodiment a rotating case pump which can achieve two-phase pumping and/or phase separation in one stage, using either continuous or alternating pulse flow. For more complete separation, several stages may be used.

SUMMARY OF THE INVENTION

The modification disclosed herein is the addition of a second inlet orifice in the stationary arm whereby gas in two-phase flow would accumulate and be removed at an orifice separate from the existing liquid inlet orifice, usually positioned at the outermost end of the stationary arm.

This device can be used as a type of centrifugal separation which takes a mixed phase in its inlet port or can be used as a two-phase pump in much the same manner. In another operational mode, liquid pulses and gas pulses can be separately allowed to flow into the pump.

When mixed phase feed is being transported a sensor such as the Hydril Flow Detector (Hydril Co. Control Systems, Anaheim, California), which can close the gas port when liquid is present and open the port to admit gas, can be mounted in the gas port. This particular detector, commercially available, is operable at pressures of 275 to 3600 psi and at temperatures of from −50° to +100°F.

More particularly, the present application provides in a centrifugal pump comprising:

a. a generally cylindrical pump case rotatable about its central axis and defining a closed cylindrical main pump chamber, b. a stationary arm extending from said central axis to a point within the case, c. a central inlet port by which fluid enters said closed main pump chamber, d. a fluid inlet orifice mounted on the outermost end of said stationary arm, e. a fluid outlet port, f. a passageway positioned and defined within said stationary arm providing fluid communication from said inlet orifice to said outlet port, and g. means for rotating said case whereby fluid charge is drawn at inlet pressure into the case via the inlet port, transported to the outer section of the pump case by centrifugal force, removed at a pressure essentially higher than the inlet pressure by the inlet orifice and transported to an exterior location at said pressure higher than the inlet pressure, an improvement which comprises:

a. a second fluid inlet orifice positioned on the stationary arm at a location essentially closer to the central axis of the rotatable case than the fluid inlet orifice recited above, b. a second fluid outlet port, and c. a second passageway positioned within said stationary arm providing fluid communication from said second fluid inlet orifice to said second fluid outlet port whereby a second fluid drawn into the case via the inlet port at inlet pressure is removed at a pressure essentially higher than the inlet pressure by said second fluid inlet orifice and transported via said second passageway and said second outlet port to a second exterior location at said pressure higher than the inlet pressure.

The invention may be more fully understood by referring to the following figures and descriptions of the preferred embodiments.

DESCRIPTION OF THE DRAWING AND PREFERRED EMBODIMENT

Figure 1:
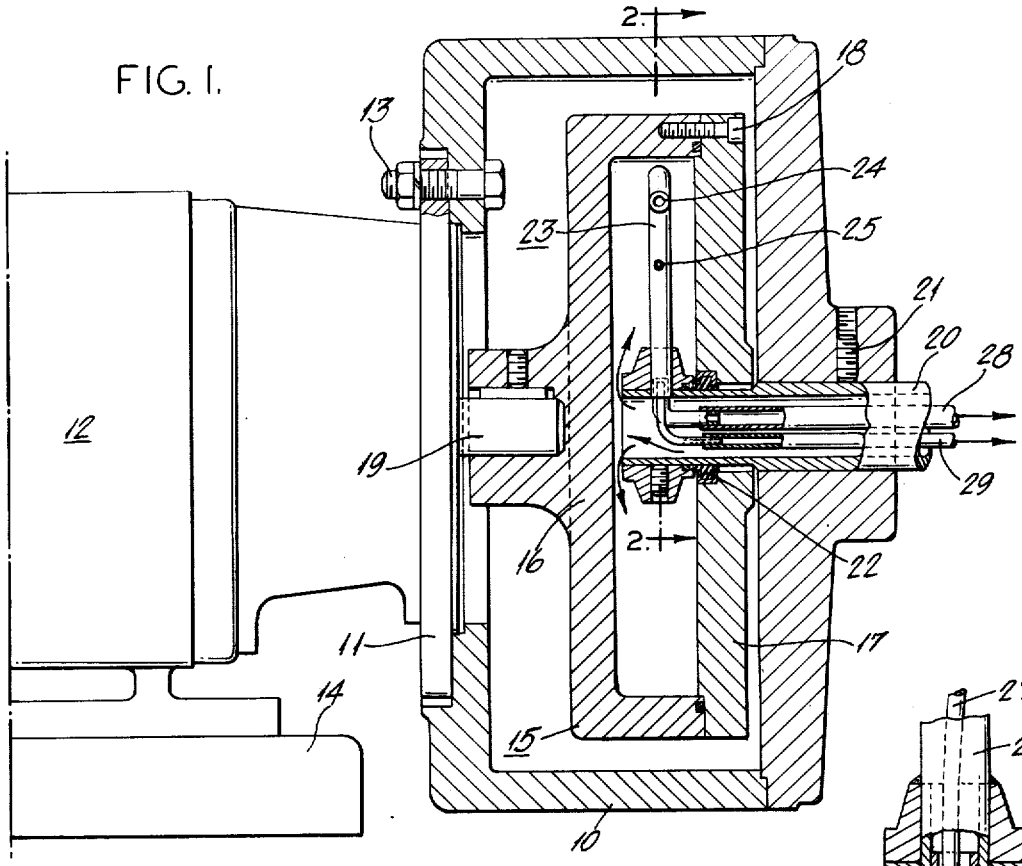
FIG. 1 is a schematic diagram of a centrifugal pump according to this invention connected to a motor with the centrifugal pump appearing in a section.
Figure 2:
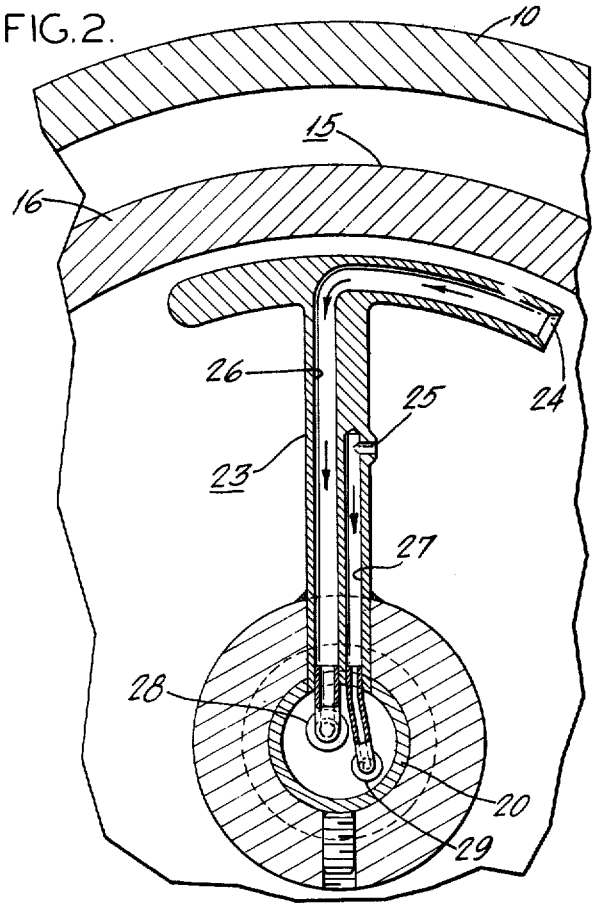
FIG. 2 is a sectional view of the stationary arm, taken along the line 2—2 in FIG. 1.

One possible method of constructing a centrifugal pump is illustrated in FIG. 1. A pump housing 10 contains the operable parts of the pump. Pump housing 10 is secured to the frame 11 of motor 12 by bolts 13. Motor 12 is preferably secured to a sturdy base 14. Inside pump housing 10 the pump case 15 is mounted. Pump case 15 has two sections 16 and 17 secured together by bolts 18. Section 16 is secured to the rotatable shaft 19 of motor 12. An inlet port 20 extends through the opposite side of pump housing 10 and through section 17 of case 15. Inlet port 20 is secured to pump housing 10 by setscrew 21, thereby preventing its rotation. A seal 22 is provided to prevent leaks at the point when inlet port 20 passes through case 15. The inside end of inlet port 20 opens into the inside of case 15. A stationary arm 23 is secured to the portion of inlet port 20 which is inside case 15 and extends radially therefrom. The shape of arm 23 should be such as to permit minimum fluid turbulence during pumping. Two inlet orifices, 24 and 25, on stationary arm 23 are provided. Each orifice preferably has a circular intake opening at its leading edge, which extends forward of the leading edge of stationary arm 23. Internal passageways 26 and 27 provide fluid communication between inlet orifice 24 and 25 and outlet ports 28 and 29, respectively.

When operating the pump, fluid having two phases is pulled into inlet port 20 at low inlet pressures by the centrifugal forces created by rotating case 15. The centrifugal force causes the fluid to move outwardly, forcing the denser phase to concentrate at the outer most portion inside case 15. The less dense phase remains closer to the center of case 15. The momentum of the fluid created by the centrifugal force causes each phase to be forced through its respective inlet orifice at high pressures. The denser phase enters inlet orifice 24, flows through passageway 26 and exits the pump through outlet port 28. Likewise, the lighter phase enters inlet orifice 25, flows through passageway 27 and exits through outlet port 29. The outlet pressures are greater than the inlet pressures due to the centrifugal forces created to propel the fluid through the pump.

Several design changes can be made to alter the characteristics of the pump. The location of the inlet orifices can be changed to better receive the particular phases that are to be pumped. Preferably, one orifice needs to be located on the outer end of stationary arm 23 to receive the denser phase. The second orifice can be located anywhere along the leading edge of stationary arm 23 between orifice 24 and inlet port 20. The exact location depends upon the density of the phase to be pumped as well as its concentration in the initial mixed phase fluid and the speed of rotation.

Also, three or more inlet orifices can be used. This configuration would be desirable where the separation of a hydrocarbon, water, and gas mixture was desired.

Several design variations of stationary arm 23 are possible. The size of the internal passageways and outlet ports can be varied to be proportional to the relative concentration of each phase in the mixed-phase fluid. Another possibility is the addition of several stationary arms having different lengths with inlet orifices located on the end of each arm.

Figure 4:
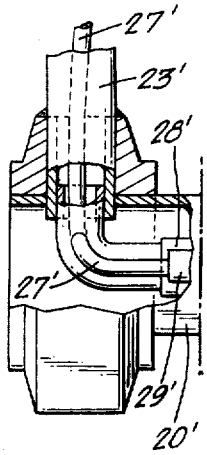
FIG. 4 is a fragmentary section of the stationary arm along line 4—4 in FIG. 3.
Figure 3:
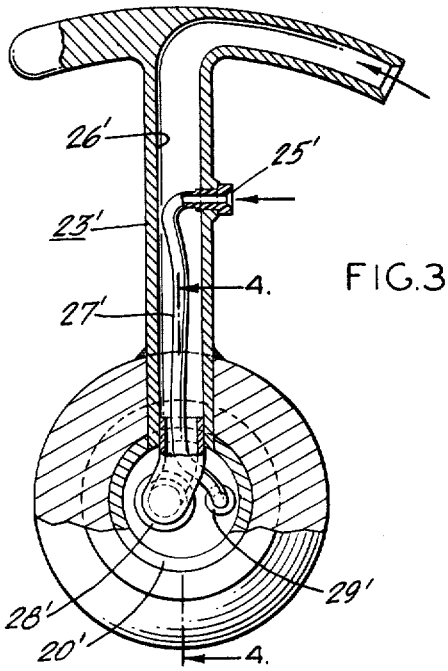
FIG. 3 is a fragmentary section of a conventional single phase stationary arm adapted for double phase pumping according to the invention.

Easy installation of a second inlet orifice in a conventional centrifugal pump having only one inlet orifice 24' is possible, as seen in FIGS. 3 and 4. A second inlet orifice 25' is installed in the leading edge of the stationary arm 23' at the appropriate radius. An outlet port 29' is placed inside the inlet port 20' or outlet port 28', and a tube 27' is placed inside the original internal passageway 26' to provide fluid communication between the second inlet orifice 25' and its outlet port 29'.

Several methods of operating the multi-phase pump are possible. The pump can be charged alternately with one phase and then another. It can be slugged with a mixed phase fluid and allowed to run until the case is empty or until a predetermined residence time has elapsed. The pump can also be operated continuously. In the continuous operation, better control of the pump might be needed. For instance, a sensor (not shown) could be used to detect the type of fluid being received by inlet orifice 25. If a gas phase is not being received, the exit passage would be closed and the speed of rotation or rate of mixed phase fluid flow into the pump would be altered to achieve the proper balance between phases. A control valve and sensing system, of a type previously mentioned, can be mounted in stationary arm 23 at inlet orifice 25 to perform this function.

Control systems which can automatically control the pump in response to the control valve and sensing system are known to those skilled in the art.

Use of several pumps connected in series can permit more refined separation of the phases since the phase becomes more pure after passage through each stage.

While particular embodiments of the invention have been described, it is obvious that changes and modifications can be made without departing from the true spirit and scope of the invention. It is the intention of the appended claims to cover all such changes and modifications.

The invention claimed is:

1. In a centrifugal pump comprising:

a generally cylindrical pump case rotatable about a central axis and defining a closed cylindrical main pump chamber, a stationary arm extending from said central axis to a point within the case, a central inlet port by which fluid enters said closed main pump chamber, a fluid inlet orifice mounted on the outermost end of said stationary arm, a fluid outlet port, a passageway positioned within said stationary arm providing fluid communication from said inlet orifice to said fluid outlet port and means for rotating said case whereby fluid charge is drawn at inlet pressure into the case via the inlet port, transported to the outer section of the pump case by centrifugal force, removed at a pressure essentially higher than the inlet pressure by the inlet orifice and transported to an exterior location at said pressure higher than the inlet pressure, an improvement comprising:

a. a second fluid inlet orifice positioned on the stationary arm at a location essentially closer to the central axis of the rotatable case than the fluid inlet orifice recited above, b. a second fluid outlet port, and c. a second passageway positioned within said stationary arm providing fluid communication from said second fluid inlet orifice to said second fluid outlet port whereby a second fluid drawn into the case via the inlet port at inlet pressure is removed at a pressure essentially higher than the inlet pressure by said second fluid inlet orifice and transported via said second passageway and said second outlet port to a second exterior location at said pressure higher than the inlet pressure.

2. Apparatus recited in claim 1 wherein the second passageway is integrally formed within the stationary arm.

3. Apparatus recited in claim 1 wherein the second passageway comprises a tube, passing through the first passageway, connected at one end to the second fluid inlet orifice and at the other end to the second fluid outlet port.

* * * * *